US008752707B2

(12) United States Patent
McDonald et al.

(10) Patent No.: US 8,752,707 B2
(45) Date of Patent: Jun. 17, 2014

(54) FOLDABLE PACKAGING MEMBER AND PACKAGING SYSTEM USING FOLDABLE PACKAGING MEMBERS

(75) Inventors: John McDonald, Fallbrook, CA (US); Frank Comerford, Laguna Niguel, CA (US); Myles Comerford, Rancho Santa Fe, CA (US)

(73) Assignee: Clearpak, LLC, Tustin, CA (US)

( * ) Notice: Subject to any disclaimer, the term of this patent is extended or adjusted under 35 U.S.C. 154(b) by 142 days.

(21) Appl. No.: 12/958,261

(22) Filed: Dec. 1, 2010

(65) Prior Publication Data

US 2012/0043252 A1 Feb. 23, 2012

Related U.S. Application Data

(60) Provisional application No. 61/401,922, filed on Aug. 19, 2010.

(51) Int. Cl.

| | |
|---|---|
| ***B65D 81/02*** | (2006.01) |
| ***B65D 85/30*** | (2006.01) |
| ***B65B 55/20*** | (2006.01) |

(52) U.S. Cl.

USPC ..... 206/586; 53/472; 206/453; 206/592

(58) Field of Classification Search

USPC ..... 206/223, 453, 586, 587, 591, 592, 594, 206/576, 577, 523, 784; 229/198.3; 53/456, 53/472; 493/74, 84–89

See application file for complete search history.

(56) References Cited

U.S. PATENT DOCUMENTS

| | | | | |
|---|---|---|---|---|
| 1,821,692 | A | | 9/1931 | Copeland |
| 2,161,128 | A | | 6/1939 | Boyle |
| 2,746,665 | A | | 4/1950 | Wiggins |
| 2,617,573 | A | | 11/1952 | Nahoom |
| 2,807,265 | A | | 9/1957 | Oliva et al. |
| 2,948,455 | A | | 8/1960 | Frankenstein |
| 2,956,672 | A | | 10/1960 | Kirkpatrick |
| 3,047,137 | A | | 7/1962 | Kindseth |
| 3,089,631 | A | | 5/1963 | Tyrseck et al. |
| 3,326,410 | A | | 6/1967 | Asenbauer |
| 3,345,643 | A | | 10/1967 | Bradley |
| 3,434,650 | A | | 3/1969 | Goings |
| 3,695,421 | A | * | 10/1972 | Wood ..... 206/523 |
| 3,853,220 | A | | 12/1974 | Luray |
| 3,854,650 | A | * | 12/1974 | Hanaue ..... 206/521 |
| 3,899,119 | A | | 8/1975 | Roccaforte |
| 3,905,474 | A | | 9/1975 | Haibara |

(Continued)

FOREIGN PATENT DOCUMENTS

| | | |
|---|---|---|
| DE | 299 21 203 U1 | 2/2000 |
| DE | 101 05 487 A1 | 8/2002 |

(Continued)

*Primary Examiner* — Luan K Bui

(74) *Attorney, Agent, or Firm* — Knobee Martens Olson & Bear, LLP

(57) ABSTRACT

A packaging member can include a foldable member deformable between a folded state and an unfolded state and configured to form a deployed configuration in the folded state. The foldable member can include a plurality of foldable sections and a slot forming portion. The foldable sections can be configured to form a plurality of walls in the folded state. The slot forming portion can be configured to form a slot in the folded state. The slot can be configured to receive a portion of an article.

25 Claims, 14 Drawing Sheets

(56) References Cited

U.S. PATENT DOCUMENTS

| | | | | |
|---|---|---|---|---|
| 3,917,108 | A | 11/1975 | Thurman | |
| 3,994,433 | A * | 11/1976 | Jenkins et al. | 206/586 |
| 4,034,908 | A | 7/1977 | Forbes, Jr. et al. | |
| 4,077,518 | A | 3/1978 | Kisslinger et al. | |
| 4,155,453 | A | 5/1979 | Ono | |
| 4,335,817 | A | 6/1982 | Bahr | |
| 4,606,460 | A | 8/1986 | Luray | |
| 4,852,743 | A | 8/1989 | Ridgeway | |
| 4,886,299 | A | 12/1989 | Ducorday | |
| 4,923,065 | A | 5/1990 | Ridgeway | |
| 5,024,536 | A | 6/1991 | Hill | |
| 5,029,900 | A | 7/1991 | Axelrod | |
| 5,046,659 | A | 9/1991 | Warburton | |
| 5,056,665 | A | 10/1991 | Boecker et al. | |
| 5,071,009 | A | 12/1991 | Ridgeway | |
| 5,076,436 | A | 12/1991 | Bortolani et al. | |
| 5,080,497 | A | 1/1992 | Peppiatt | |
| 5,183,159 | A | 2/1993 | Hojnacki et al. | |
| 5,207,327 | A * | 5/1993 | Brondos | 206/523 |
| 5,211,290 | A | 5/1993 | Janus et al. | |
| 5,218,510 | A | 6/1993 | Bradford | |
| 5,223,121 | A | 6/1993 | Dickie et al. | |
| 5,226,542 | A | 7/1993 | Boecker et al. | |
| 5,226,734 | A | 7/1993 | Scott et al. | |
| 5,251,760 | A | 10/1993 | Smith et al. | |
| 5,323,896 | A | 6/1994 | Jones | |
| 5,372,257 | A | 12/1994 | Beauchamp et al. | |
| 5,388,701 | A | 2/1995 | Ridgeway | |
| 5,394,985 | A | 3/1995 | Van Hest | |
| 5,405,000 | A | 4/1995 | Hagedon et al. | |
| 5,492,223 | A | 2/1996 | Boardman et al. | |
| 5,579,917 | A | 12/1996 | Lofgren et al. | |
| 5,641,068 | A | 6/1997 | Warner | |
| 5,669,506 | A | 9/1997 | Lofgren et al. | |
| 5,676,245 | A | 10/1997 | Jones | |
| 5,678,695 | A | 10/1997 | Ridgeway et al. | |
| 5,694,744 | A | 12/1997 | Jones | |
| 5,722,541 | A | 3/1998 | Lofgren et al. | |
| 5,738,218 | A | 4/1998 | Gonzales | |
| 5,769,235 | A | 6/1998 | Keach et al. | |
| 5,788,081 | A | 8/1998 | Bates | |
| 5,797,493 | A | 8/1998 | Watson | |
| 5,803,267 | A | 9/1998 | Tu et al. | |
| 5,823,348 | A | 10/1998 | Phillips et al. | |
| 5,823,352 | A | 10/1998 | Mena et al. | |
| 5,893,462 | A | 4/1999 | Ridgeway | |
| 5,894,932 | A | 4/1999 | Harding et al. | |
| 5,954,203 | A | 9/1999 | Marconi | |
| 5,967,327 | A | 10/1999 | Jones | |
| RE36,412 | E | 11/1999 | Jones | |
| 5,975,307 | A | 11/1999 | Harding et al. | |
| 5,988,387 | A | 11/1999 | Staal et al. | |
| 6,006,917 | A | 12/1999 | Loeffler | |
| 6,010,003 | A | 1/2000 | Wilkinson | |
| 6,047,831 | A | 4/2000 | Jones | |
| 6,073,761 | A | 6/2000 | Jones | |
| 6,079,563 | A | 6/2000 | Katchmazenski | |
| 6,119,863 | A | 9/2000 | Lofgren et al. | |
| 6,148,591 | A | 11/2000 | Ridgeway et al. | |
| 6,158,589 | A | 12/2000 | Smith et al. | |
| 6,206,194 | B1 | 3/2001 | Beneroff et al. | |
| 6,223,901 | B1 | 5/2001 | Lofgren et al. | |
| 6,289,655 | B1 | 9/2001 | Ridgeway et al. | |
| 6,311,843 | B1 | 11/2001 | Smith et al. | |
| 6,311,844 | B1 | 11/2001 | Ridgeway et al. | |
| 6,398,412 | B2 | 6/2002 | Wedi et al. | |
| 6,467,624 | B1 | 10/2002 | Lofgren et al. | |
| 6,488,153 | B1 * | 12/2002 | Morris | 206/523 |
| 6,675,973 | B1 | 1/2004 | McDonald et al. | |
| 6,676,293 | B2 | 1/2004 | Ferris | |
| 6,899,229 | B2 | 5/2005 | Dennison et al. | |
| 6,920,981 | B2 | 7/2005 | Lofgren et al. | |
| 6,942,101 | B2 | 9/2005 | Lofgren et al. | |
| 7,000,774 | B2 | 2/2006 | Bryant | |
| 7,086,534 | B2 | 8/2006 | Roesel et al. | |
| 7,114,618 | B2 * | 10/2006 | Arnold | 206/523 |
| 7,150,356 | B2 | 12/2006 | Lofgren et al. | |
| 7,290,662 | B2 | 11/2007 | Lofgren et al. | |
| 7,293,695 | B2 | 11/2007 | Stier | |
| 7,296,681 | B2 | 11/2007 | McDonald et al. | |
| 7,299,926 | B2 | 11/2007 | Russell et al. | |
| 7,398,884 | B2 * | 7/2008 | Stegner et al. | 206/592 |
| 7,654,391 | B2 * | 2/2010 | Langer et al. | 206/523 |
| 7,669,716 | B2 | 3/2010 | Lightner et al. | |
| 7,731,032 | B2 | 6/2010 | McDonald et al. | |
| 7,743,924 | B2 | 6/2010 | McDonald et al. | |
| 7,753,209 | B2 | 7/2010 | McDonald et al. | |
| 7,775,367 | B2 | 8/2010 | McDonald et al. | |
| 7,882,956 | B2 | 2/2011 | McDonald et al. | |
| 7,931,151 | B2 | 4/2011 | Mcdonald et al. | |
| 8,028,838 | B2 | 10/2011 | Mcdonald et al. | |
| 8,123,039 | B2 | 2/2012 | Mcdonald et al. | |
| 8,177,067 | B2 | 5/2012 | Mcdonald et al. | |
| 8,235,216 | B2 | 8/2012 | Mcdonald et al. | |
| 8,499,937 | B2 | 8/2013 | Mcdonald et al. | |
| 8,505,731 | B2 | 8/2013 | Mcdonald et al. | |
| 2001/0047950 | A1 | 12/2001 | Beneroff et al. | |
| 2003/0034273 | A1 | 2/2003 | Auclair | |
| 2003/0209463 | A1 | 11/2003 | Halpin | |
| 2003/0213717 | A1 | 11/2003 | Kanai | |
| 2003/0234207 | A1 | 12/2003 | Koike | |
| 2004/0108239 | A1 | 6/2004 | McDonald et al. | |
| 2004/0178113 | A1 | 9/2004 | Lofgren et al. | |
| 2005/0011807 | A1 | 1/2005 | Dennison et al. | |
| 2005/0121354 | A1 | 6/2005 | Gillis et al. | |
| 2005/0286816 | A1 | 12/2005 | Laske | |
| 2006/0000743 | A1 | 1/2006 | Lofgren et al. | |
| 2006/0042995 | A1 | 3/2006 | McGrath et al. | |
| 2006/0102515 | A1 | 5/2006 | McDonald et al. | |
| 2006/0138018 | A1 | 6/2006 | McDonald et al. | |
| 2006/0213803 | A1 | 9/2006 | Saitou et al. | |
| 2006/0285777 | A1 | 12/2006 | Howell et al. | |
| 2007/0080095 | A1 | 4/2007 | McDonald et al. | |
| 2007/0251854 | A1 | 11/2007 | McDonald et al. | |
| 2008/0067103 | A1 | 3/2008 | McDonald et al. | |
| 2008/0099368 | A1 | 5/2008 | McDonald et al. | |
| 2008/0110788 | A1 | 5/2008 | Keiger | |
| 2008/0110794 | A1 | 5/2008 | Anderson et al. | |
| 2008/0128316 | A1 | 6/2008 | McDonald et al. | |
| 2008/0223750 | A1 | 9/2008 | McDonald et al. | |
| 2009/0272667 | A1 | 11/2009 | Mcdonald et al. | |
| 2010/0140333 | A1 | 6/2010 | Mcdonald et al. | |
| 2010/0276330 | A1 | 11/2010 | Mcdonald et al. | |
| 2010/0276332 | A1 | 11/2010 | Mcdonald et al. | |
| 2011/0095076 | A1 | 4/2011 | Knighton | |
| 2011/0259787 | A1 | 10/2011 | Mcdonald et al. | |

FOREIGN PATENT DOCUMENTS

| | | | |
|---|---|---|---|
| EP | 1 561 693 | A1 | 8/2005 |
| JP | 5-305956 | | 11/1993 |
| SU | 827346 | A1 | 5/1981 |
| WO | WO 00/53499 | A2 | 9/2000 |

* cited by examiner

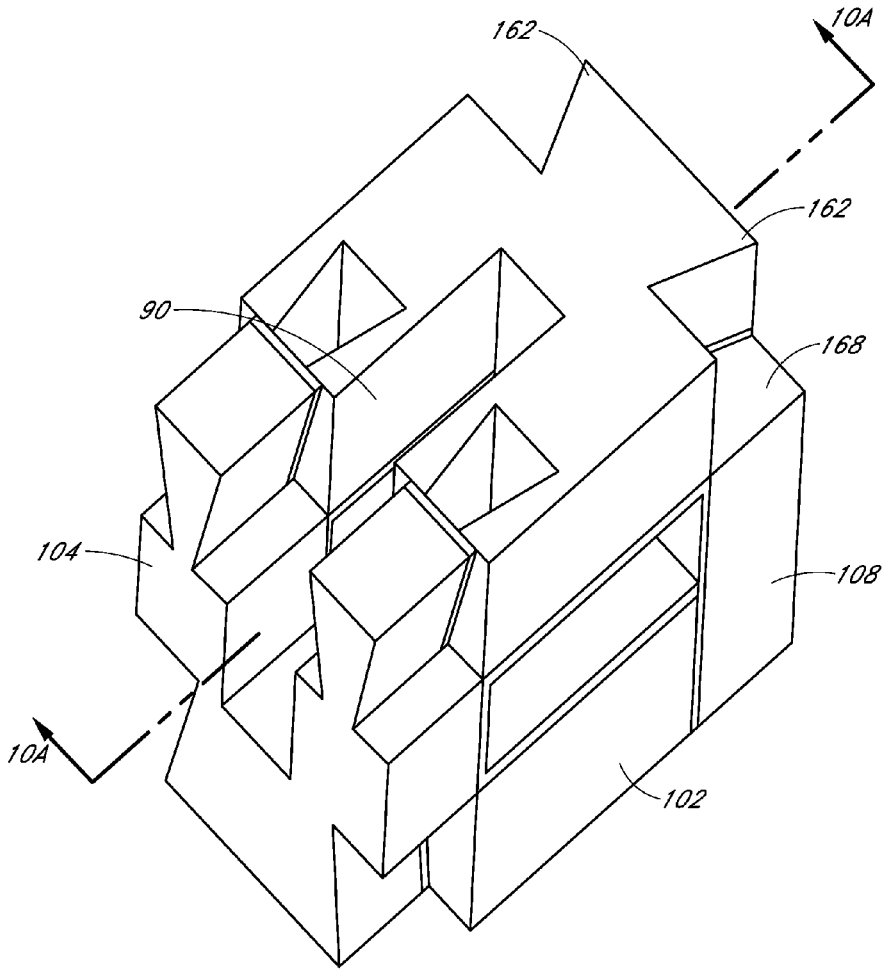
162
10A
162
90
168
104
108
10A
102

FOLDABLE PACKAGING MEMBER AND PACKAGING SYSTEM USING FOLDABLE PACKAGING MEMBERS

RELATED APPLICATIONS

This application claims priority to U.S. Provisional Patent Application No. 61/401,922, titled FOLDABLE PACKAGING MEMBER AND PACKAGING SYSTEM USING FOLDABLE PACKAGING MEMBERS, filed Aug. 19, 2010, the entire contents of which is hereby expressly incorporated by reference.

BACKGROUND OF THE INVENTIONS

1. Field of the Inventions

The present inventions are directed to packaging members, for example, foldable packaging members that include a plurality of foldable sections.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and unloading.

In most cases, some additional structure is used to keep the article from moving uncontrollably within the box. Such additional structures include paper or plastic packing material, structured plastic foams, foam-filled cushions, and the like.

SUMMARY OF THE INVENTIONS

An aspect of at least one of the inventions disclosed here includes the realization that packaging members can be constructed in a manner such that they can be transported in bulk in a compact state then folded into a deployed configuration so as to provide sufficient cushioning for an intended article. For example, such a packaging member can be constructed as a flat material, processed in some manner so as to make it foldable. The processed members can be stacked for bulk transportation to a facility where the member will be used to package an article of commerce, for example, retail sales packaging. At said facility, the flat packaging members can be folded into the folded configuration and disposed around the intended article for packaging. As such, the packaging members achieve the dual goals of providing reduced transportation costs and sufficient cushioning.

In accordance with some embodiments, a packaging member can comprise a plurality of foldable sections arranged in a row in an unfolded state. The plurality of foldable sections can be configured to form a planar shaped configuration in the unfolded state, and further configured to form a block shaped configuration in a deployed state. In the block shaped configuration, the plurality of foldable sections can be configured to form a packaging corner block. The packaging corner block can comprise a slot formed around a corner of the packaging corner block and configured to receive a corner portion of an article, and two shoulders generally opposing each other and arranged such that the slot is located therebetween. One of the two generally opposing shoulders can be configured to cushion the corner portion of the article received in the slot in a first direction extending between the two generally opposing shoulders. The other shoulder can be configured to cushion the corner portion of the article received in the slot in a second direction opposite to the first direction. The packaging corner block can comprise a first cushioning support configured to cushion the corner portion of the article received in the slot in a third direction perpendicular to the first direction, and a second cushioning support configured to cushion the corner portion of the article received in the slot in a fourth direction perpendicular to the first and third directions.

In the foregoing packaging member, the packaging corner block can have a generally rectangular cuboid shape. In the deployed state, the plurality of foldable sections can be arranged to form a circumferentially closed shape of the packaging corner block. Further, the plurality of foldable sections can comprise two end portions located at opposing ends of the packaging member in the unfolded state, respectively, wherein the two end foldable sections abut each other in the deployed state.

In some embodiments, the plurality of foldable sections can comprise a first foldable section and a second foldable section immediately neighboring the first foldable section, wherein the first and second foldable sections are hingedly connected to each other such that the first foldable section is pivotable with respect to the second foldable section about a hinge. The first foldable section can comprise a male member, and the second foldable section can comprise a female member which is configured to engage with the male member in the unfolded state. Each of the male and female members can have a trapezoidal shape. The male and female members can be configured to interfere each other and at least partially deform when the first foldable section pivots relative to the second foldable section between the unfolded state and the deployed state.

In other embodiments, the male and female members can be configured not to interfere each other when the packaging member is in the unfolded state or in the deployed state. The male and female members can be configured to be disengaged from each other in the deployed state. The packaging member can further comprise a foldable tab pivotably connected to the first foldable section and configured to be inserted between the male and female members which are disengaged in the deployed state. The foldable tab can be configured to interfere with the female member when the foldable tab pivots relative to the first foldable section. The male and female members can be configured to form a lock mechanism which is configured to keep the first and second foldable sections in the unfolded state or in the deployed state.

In some embodiments, the packaging member can comprise a cushioning material of an expanded compressible, resilient material. The packaging member can be formed in a single piece. The packaging member may have a thickness substantially uniform throughout the foldable sections in the unfolded state. Each of the plurality of foldable sections can comprise a first layer of a cushioning material and a second layer of a sheet material attached to the first layer, and the first layers of two immediately neighboring foldable sections among the plurality of foldable sections unjoined while the second layers of the immediately neighboring foldable sections are at least partially joined to each other.

A first one of the plurality of foldable sections can comprise a slot forming portion configured to form at least part of the slot of the packaging corner block in the deployed state and two shoulder forming portions configured to form the two shoulders of the packaging corner block in the deployed state. The first foldable section can comprise a portion configured to form the first cushioning support of the packaging corner block in the deployed state. A second one of the plurality of foldable sections can be configured to form the second cushioning support of the packaging corner block in the deployed state.

In some embodiments, a method of packaging an article is provided. The method can comprise providing a box having at least a corner, and providing the forgoing packaging member in its unfolded state. The method can further comprise folding the packaging member into the block shaped configuration thereby forming the packaging corner block, placing the packaging corner block inside the box at the corner of the box, inserting a corner of an article into the slot of the packaging corner block. In the foregoing method, subsequent to inserting the packaging corner block can be placed inside the box at the corner of the box. In some alternative embodiments, subsequent to placing the packaging corner block inside the box at the corner of the box, the corner of an article can be inserted into the slot of the packaging corner block.

In some embodiments, a packaging system can comprise a box comprising a corner and configured to contain an article, and the foregoing packaging member in its folded state. The packaging member can be disposed at the corner of the box to receive a corner of the article. In other embodiments, a package kit can comprise a box forming member and the foregoing packaging member. The box forming member can comprise a plurality of foldable portions configured to form walls of a box in its folded state, wherein the box comprises a corner and is configured to contain an article. The packaging member can be configured to form in its folded state the packaging corner block which fits the corner of the box and is configured to receive a corner of the article.

In other embodiments, a method of making a packaging member is provided. The method can comprise providing a packaging material comprising a first layer and a second layer, and partially cutting the packaging material into the plurality of foldable sections of the foregoing packaging member such that two immediately neighboring foldable sections are at least partially joined at the second layer. In the foregoing method, the first layer can comprise a cushioning material and the second layer can comprise a sheet material.

In accordance with some embodiments, a packaging member is provided. The packaging member can comprise a foldable member deformable between a folded state and an unfolded state and configured to form a deployed configuration in the folded state. The foldable member can comprise a plurality of foldable sections configured to form a plurality of walls in the folded state, and a slot forming portion configured to form a slot in the folded state, the slot being configured to receive a portion of an article. The foldable member can also comprise an unjoined portion and a joined portion between two immediately neighboring foldable sections, wherein the joined portion is configured to form a hinge about which the two neighboring foldable sections are pivotable relative to each other.

In the foregoing packaging member, the joined portion can have a thickness which is part of a thickness of the foldable member. The unjoined portion can comprise a partial cut portion extending partially through a thickness of the foldable member. The unjoined portion can further comprise a complete cut portion extending throughout a thickness of the foldable member. The foldable member can have a thickness substantially uniform in the unfolded state throughout the foldable sections. The foldable member can comprise a first layer of a cushioning material and a second layer of a sheet material attached to the first layer. The joined portion can be formed in the second layer. The packaging member can be formed in a single piece.

Further, in the foregoing packaging member, the foldable member can comprise a lock structure configured to keep the folded state of the two immediately neighboring foldable sections from unfolding. The foldable member can comprise a lock structure configured to keep the unfolded state of the two immediately neighboring foldable sections from folding. One of the two immediately neighboring foldable sections can comprise a dovetail-shaped female member and the other can comprise a dovetail-shaped male member configured to mate with the dovetail-shaped female member in the unfolded state. The dovetail-shaped male and female members can be configured to form a lock structure in at least one of the folded and unfolded states. The other foldable section can comprise a foldable portion configured to be inserted into a space formed by the dovetail-shaped female member in the folded state, and form an additional lock structure configured to keep the folded state of the two immediately neighboring foldable sections.

In the foregoing packaging member, the plurality of foldable sections can comprise a first end section, a second end section and at least a first intermediate section interposed between the first end section and the second end section in the unfolded state, wherein the slot forming portion is disposed in the first intermediate section. The slot forming portion can comprise at least a foldable portion pivotably connected to one of the plurality of foldable sections, wherein the slot is formed when the foldable portion is folded. The foldable portion can be configured to provide additional cushioning for the article supported by the packaging member in the folded state.

In accordance with another embodiment, a packaging system is provided. The packaging system can comprise a box, and the foregoing packaging member in its folded state. The packaging member can be disposed at a corner of the box to receive a corner of an article.

In accordance with a further embodiment, a package kit is provided. The package kit can comprise a container forming foldable member comprising a plurality of foldable portions configured to form walls of a box in its foldable state, and the foregoing packaging member. The packaging member can be configured to form a deployed configuration. The packaging member in its deployed configuration can be configured to be inserted in a corner of the box.

Further in accordance with another embodiment, a method of making a packaging member can comprise providing a packaging material having a thickness and cutting the packaging material to form a plurality of foldable sections. Such cutting can form, between two immediately neighboring foldable sections, at least one complete cut portion extending throughout the thickness and at least one partial cut portion extending through a portion of the thickness. At least one partial cut portion can form a joined portion about which the two immediately neighboring foldable sections are pivotable with each other.

The foregoing method can further comprise folding the foldable sections into the folded state thereby forming a deployed configuration. The packaging member in its deployed configuration can be configured to cushion a corner of an article. The packaging member in its deployed configuration can comprise a slot configured to receive the corner of the article.

BRIEF DESCRIPTION OF THE DRAWINGS

These and other features of the inventions are described below with reference to the drawings of several embodiments of the present packaging members and kits which are intended to illustrate, but not to limit, the inventions. The drawings contain the following figures:

FIG. 9 is a front, top, and right side perspective view of the packaging member in a completely folded state;

DETAILED DESCRIPTION OF EMBODIMENTS

Improved packaging members in accordance with embodiments are disclosed herein. The packaging members include improved structures which provide new alternatives to known packaging systems.

In the following detailed description, terms of orientation such as "top," "bottom," "front," "rear," "right," "left," "lower," "central," and "end" may be used here to simplify the description in the context of the illustrated embodiments. Because other orientations are possible, however, the present inventions should not be limited to the illustrated orientations. Those skilled in the art will appreciate that other orientations of various components described herein are possible.

Figure 1A:
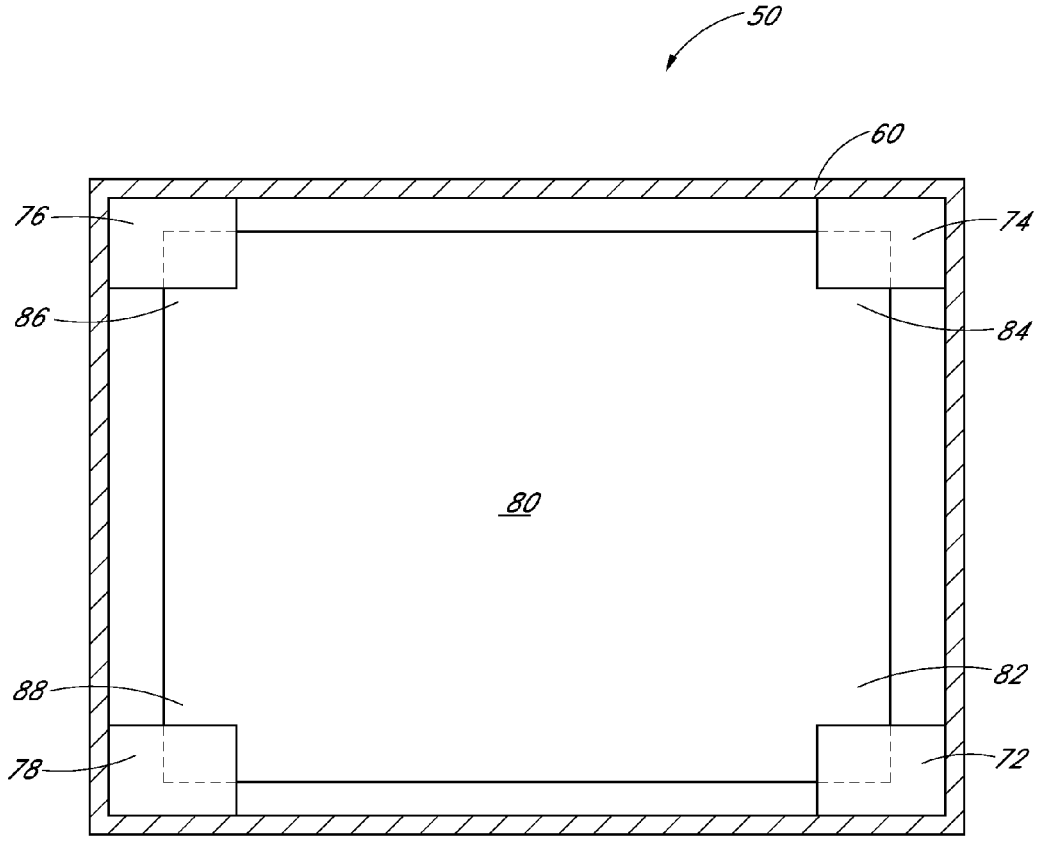
FIG. 1A is a sectional view of a packaging system in accordance with embodiments along with an article packaged within the packaging system.

With reference to FIG. 1A, a packaging system 50 can include a box 60 and four packaging corner blocks 72, 74, 76 and 78 constructed of a cushioning material. In some embodiments, an article 80 having a rectangular panel shape can be securely packaged in the box 60 using the packaging corner blocks 72, 74, 76 and 78. In this example, four corner portions 82, 84, 86, and 88 of the article 80 are supported by the packaging corner blocks 72, 74, 76 and 78, respectively.

Figure 1B:
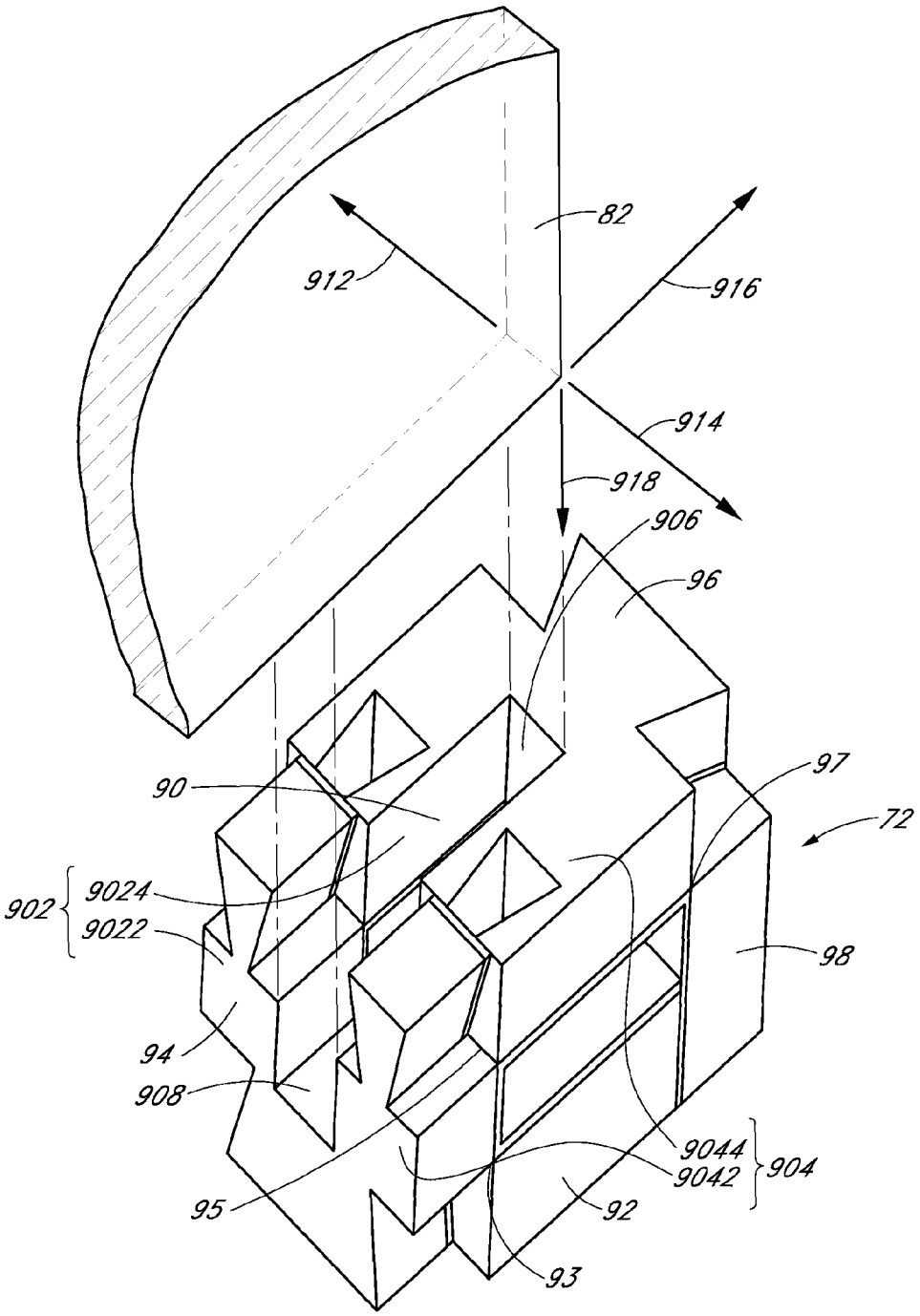
FIG. 1B is a perspective view of a deployed configuration of a packaging member shown in FIG. 1, illustrating a corner portion of an article being inserted in the packaging member.

As illustrated in FIG. 1B, the packaging corner block 72 can be constructed for receiving the corner portion 82 of the article 80. For brevity, the construction of the packaging corner block 72 is described. However, it is to be understood that each of the other packaging blocks 74, 76 and 78 also can include the same features.

Referring to FIG. 1B, the corner block 72 can include a slot 90. In some embodiments, the slot 90 can be sized such that the corner portion 82 of the article 80 tightly fits therein. In other embodiments, the slot 90 is sized to receive the corner portion 82 without interference. The corner block 72 can include two opposing shoulder portions 902 and 904. The slot 90 is located between the shoulder portions 902 and 904. The shoulder portion 902 can provide cushioning to the article against the movement of the article in a direction 912. The shoulder portion 904 can provide cushioning to the article against the movement of the article in a direction 914. In some embodiments, the corner block 72 can include a first support portion 906 and a second support portion 908. The first support portion 906 can provide cushioning to the article against the movement of the article in a direction 916, and the second support portion 908 can provide cushioning to the article against the movement of the article in a direction 918. Thus, the article can be protected from impacts applied from outside the box when it is packaged in the box.

Figure 1C:
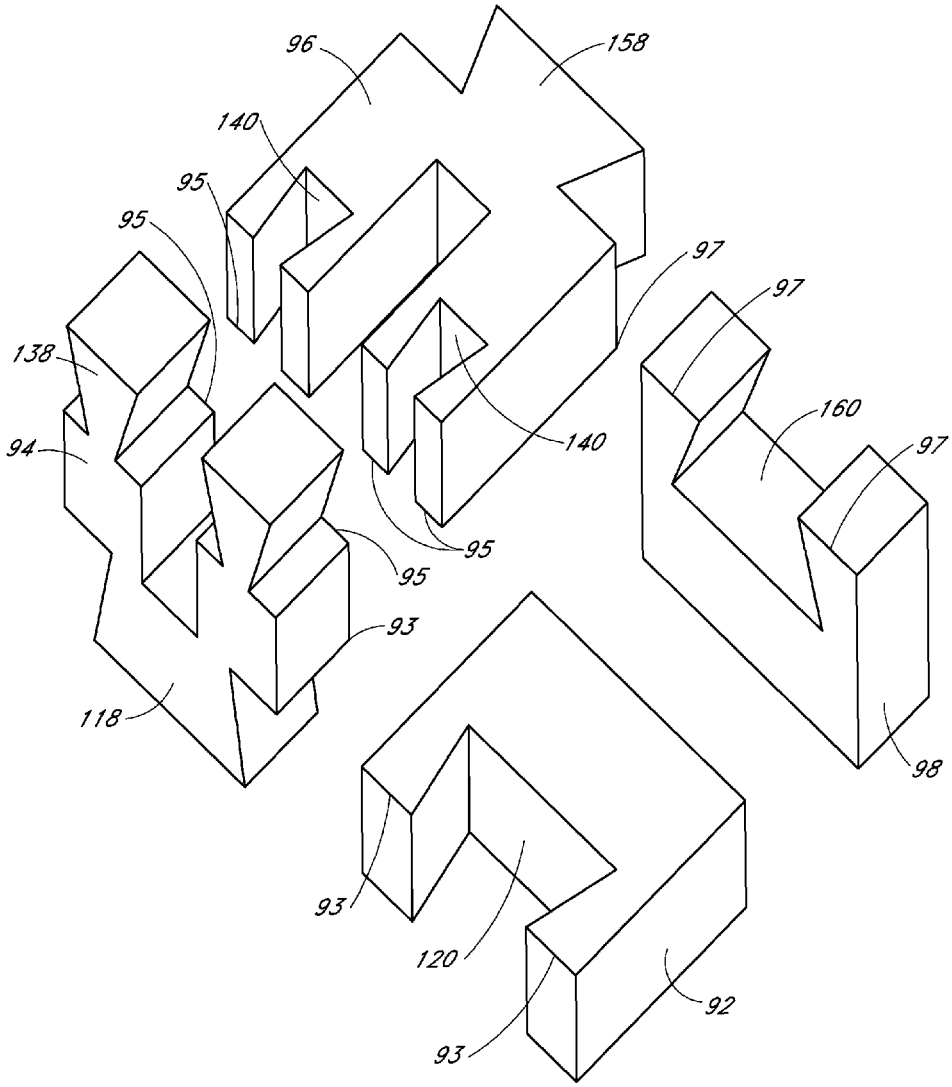
FIG. 1C is an exploded, perspective view of portions of the packaging member shown in FIG. 1.

As shown in FIGS. 1B and 1C, four walls 92, 94, 96 and 98 can collectively form a block shaped configuration in their deployed state to provide the packaging corner block 72 in some embodiments. The packaging corner block can have a generally rectangular cuboid shape or prism shape, but not limited thereto. In some embodiments, the packaging corner block can have a cubic shape. The walls 92, 94, 96 and 98 can includes portions which, in the deployed state, forms the slot 90, the shoulders 902 and 904, and the support portions 906 and 908. Although FIG. 1C shows the walls 92, 94, 96 and 98 disconnected from each other only for convenience, the wall 92 can be pivotally connected to the wall 94 at edges 93. Likewise, the wall 94 can be pivotally connected to the wall 96 at edges 95, and the wall 96 can be pivotally connected to the wall 98 at edges 97.

Two immediately neighboring walls joined to each other can also have locking structures or mating structures which can mate with each other in the block shaped configuration 72 as described in greater detail below. In some embodiments, a slot 90 can be formed in the walls 94 and 96 to receive the corner 82 of the article 80.

Referring again to FIGS. 1A and 1B, the article 80 can be a TV with a flat panel display including but without limitation a liquid crystal display, a plasma display, an organic light-emitting diode display, a light-emitting diode display, or the like. The article 80 can include but without limitation a computer monitor with a flat panel display, a notebook computer or any other electronic device with a flat panel shape. Further, in some embodiments, the packaging system 50 using the packaging members can be used for packaging any flat panel shaped articles, but not limited thereto. In some embodiments, the packaging system can be used for packaging any article with a corner flange or a little flat extension that can be engaged with the packaging member even if it generally has a non-flat shape.

When packaging the article 80, the box 60 having a lid on the top thereof is provided in some embodiments. Two corner blocks 72 and 78 are located at the bottom corners of the box 62. In some embodiments, the width of the corner block 72 can be sized such that the corner block 72 can be dropped from the top of the box 60 to the corner 82 of the box 60. In other embodiments, the width of the corner block 72 can be sized such that the corner block 72 tightly fits into a span between two walls of the box 60. Subsequent to positioning the corner blocks 72 and 78, the article 80 can be inserted into the box 60, and the corner block 74 and 76 are engaged with the corners 84 and 86 of the article 80. Subsequently, the top lid of the box 60 is closed, and the packaging is completed. In alternative embodiments, the corner blocks 72, 74, 76 and 78 can be engaged with the corners 82, 84, 86 and 88 of the article 80, respectively, prior to inserting the article into the box 60. Subsequently, the article 80 and corner blocks 72, 74, 76 and 78 can be disposed in position within the box.

Figure 2:
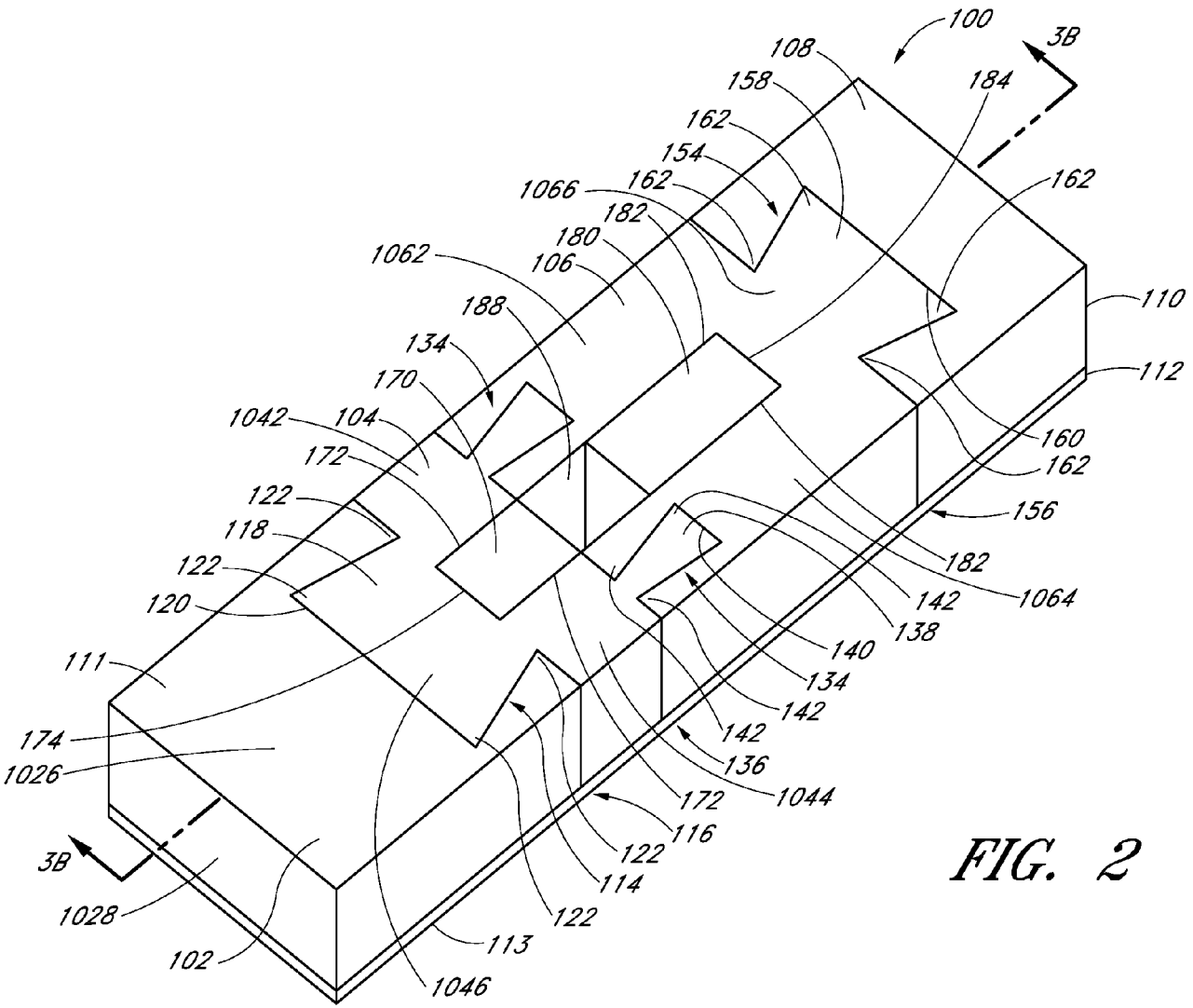
FIG. 2 is a front, top, and right side perspective view of a packaging member in an unfolded state.

With reference to FIG. 2, a packaging member 100 is illustrated therein and is constructed in accordance with some embodiments. The packaging member 100 can be configured to form the packaging corner block 72 when manipulated into the folded state. This can provide advantages, for example but without limitation, in transporting a large number of the packaging members, as they can be transported in bulk in a compact state then folded into a deployed configuration so as to provide sufficient cushioning for an article.

The packaging member 100 can include plural sections in a row and form a planar shape in the unfolded state. In some embodiments, the packaging member 100 can be a single piece and can have four sections but not limited thereto. The four sections can include a first end section 102, a first intermediate section 104, a second intermediate section 106 and a second end section 108 which form the walls 92, 94, 96 and 98, respectively, when the packaging member 100 is in a folded state as illustrated in FIG. 1B.

In some embodiments, the packaging member 100 can be constructed from various materials but without limitation, plastic, paper, and other appropriate materials. The chosen material for constructing the member 110 can be any substantially flexible and foldable material. It will be appreciated that, although denominated as flexible, the chosen material would preferably have a certain amount of rigidity.

In some embodiments, the packaging member 100 can have at least two layers attached to each other. A first layer 110 can provide cushioning for the corner portions of the article 80 when the article 80 is packaged. For example, the first layer 110 can be formed from an expanded compressible, resilient material. The expanded material can include cells which are open or closed. The first layer 110 can be relatively thick and can be formed from a plastic foam material which includes, for example but without limitation, polypropylene foam, polyethylene foam, PVC foam, polyurethane foam, cross-linked foam and the like. In some embodiments, the first layer 110 can be formed with polyethylene foam with a density of about 0.8 $lb/ft^3$, about 1 $lb/ft^3$, about 1.2 $lb/ft^3$, about 1.4 $lb/ft^3$, about 1.7 $lb/ft^3$, about 2 $lb/ft^3$, about 2.3 $lb/ft^3$, about 2.5 $lb/ft^3$, about 3 $lb/ft^3$, or about 3.5 $lb/ft^3$, but not limited thereto. In other embodiments, a honeycomb board and a cardboard can be used for the first layer 110. The physical or mechanical properties of the first layer 110, such as, stiffness, tensile strength, compression strength and the like can vary to provide sufficient protection or cushioning for the article 80 which is supported by the packaging members.

A second layer 112 attached to the first layer as a backing layer or a skin can be formed of a flexible plastic sheet, for example but without limitation, polyethylene sheet, polypropylene sheet, PVC sheet, elastomer sheet and the like. In some embodiments, the flexible plastic sheet can be made of a plastic foam material, for example without limitation, polypropylene foam, polyethylene foam, PVC foam, polyurethane foam and the like. For example, the second layer 112 can be formed with polyethylene foam with a density of about 4 $lb/ft^3$, about 5 $lb/ft^3$, about 6 $lb/ft^3$, or about 8 $lb/ft^3$, but not limited thereto. In other embodiments, the second layer 112 can be formed of a paper sheet. The second layer can be relatively thin. The second layer 112 can be configured to provide durability against repeated tensioning or bending.

In an example but non-limiting embodiment, a material generally known as "CHAR POLYLAM" foam can be used for the packaging member 100. However, this is merely an example, and any other foam material can be used for the packaging member 100.

The size, such as, length, width and thickness of the packaging member 100 can be chosen by one of ordinary skilled in the art to provide a proper size of each corner block when manipulated into the folded state. Dimensions of a packaging member 100 for packaging a big screen TV such as 50"-70" TVs can be greater than those of a packaging member 100 for packaging a small screen TV such as 25"-40" TVs. However, it is to be understood that the packaging member 100 can have various dimensions for use in packaging articles including, for example, digital photo display devices, notebook computers or any other articles that can benefit from cushioning devices.

Referring to FIGS. 2, 3A, 3B and 4, the first end section 102 and the first intermediate section 104 neighboring each other can be partially joined to each other at or near the bottom 113 of the packaging member 100. Each of such joined portions can provide a hinge or folding line 116 about which the first end section 102 and first intermediate section 104 pivot relative to each other. The first end section 102 and first intermediate section 104 can be unjoined at the most portion of the interface therebetween.

In some embodiments, the first end section 102 and the first intermediate section 104 can include a mating structure or lock structure 114 located between the folding lines 116. The mating structure 114 can prevent or hinder the first end section 102 and the first intermediate section 104 from their relative movement until a user applies force to fold the sections 102 and 104, thereby helping to maintain the packaging member 100 in the unfolded state. This can provide further advantages in handling each or a number of the packaging members, for example but without limitation, when stocking shelves as they do not need special handling to avoid unintended folding.

In some embodiments, the mating structure 114 can have a dovetail-shaped male member or trapezoidal shaped male member 118 and a dovetail-shaped female member or trapezoidal shaped female member 120, but not limited thereto. Each of the male and female members can have at least one undercut portion 122. In some embodiments, the male and female members 118 and 120 are engaged when the packaging member 100 is in an unfolded state, and disengaged when the packaging member 10 is in the deployed state. The male and female members 118 and 120 interfere each other and at least partially deform when the first end section 102 pivots relative to the first intermediate section 104 between the unfolded state and the deployed state.

Figure 3A:
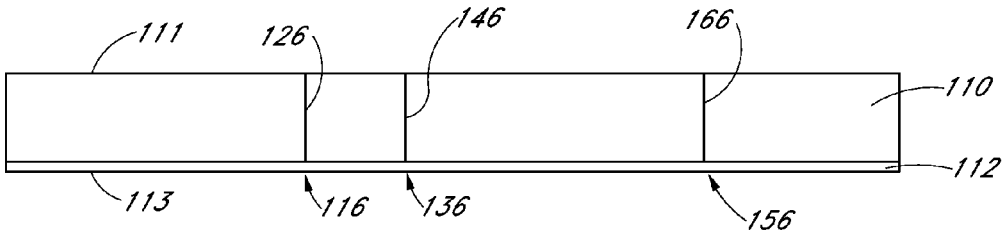
FIG. 3A is a side view of the packaging member shown in FIG. 2.
Figure 3B:
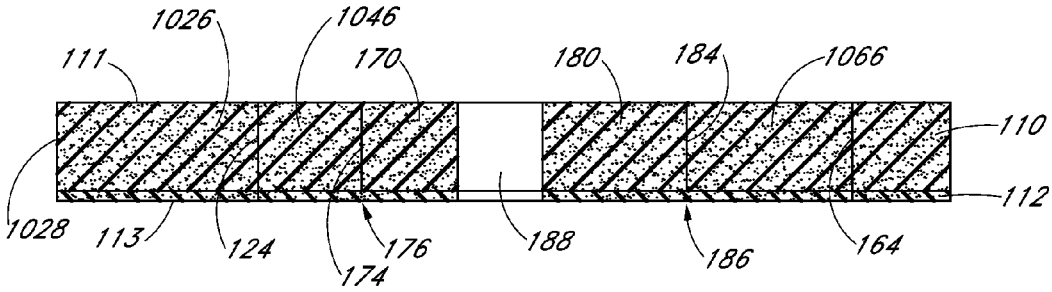
FIG. 3B is a sectional view taken along the line 3B-3B of FIG. 2.
Figure 4:
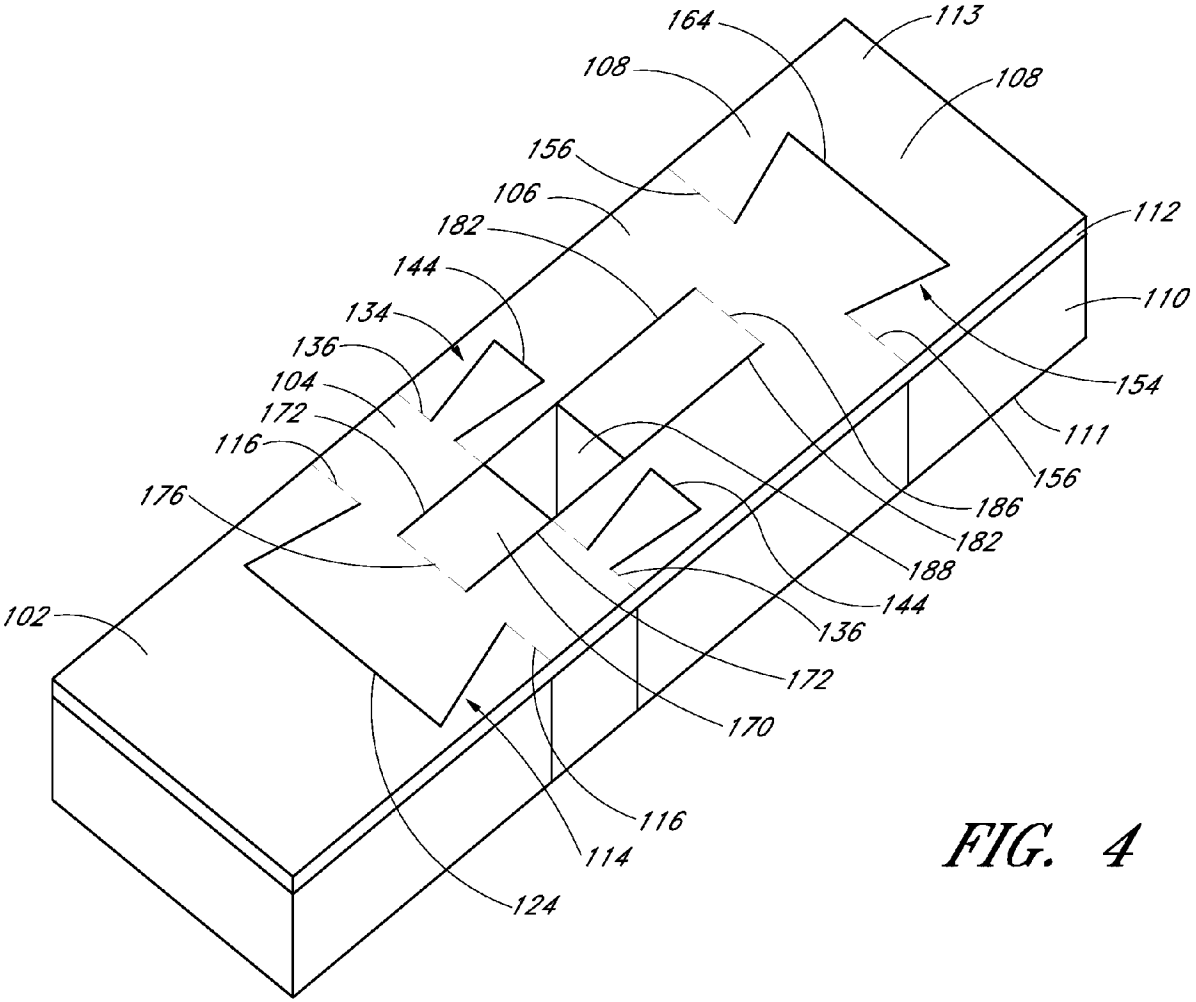
FIG. 4 is a bottom, rear, and right side perspective view of the packaging member shown in FIG. 2.

In some embodiments, to form the dovetail-shaped male and female members a complete cut portion can be provided between the first end section 102 and the first intermediate section 104. As shown in FIG. 3B, the complete cut portion 124 which extends from a top 111 to the bottom 113 through the first layer 110 and the second layer 112. Thus, as shown in FIG. 4, cut lines 124 are shown in the bottom 113. Referring to FIGS. 2, 3A and 4, between the first end section 102 and the first intermediate section 104, there can be partial cut portions 126 extending from the top 111 to or near the interface of the first and second layers 110 and 112, leaving the second layer 112 uncut as illustrated in FIG. 3A. The uncut portion can form the joined portion 116 discussed above.

In some embodiments, the first end section 102 can include a support forming portion 1026, which can form a portion of the cushioning support 908 of the packaging corner block 72 shown in FIG. 1B. The support forming portion 1026 extends from the dovetail-shaped female member 120 to an end 1028.

The first intermediate section 104 can include a support forming portion 1046, which can form a portion of the cushioning support 908 of the packaging corner block 72 shown in FIG. 1B.

With reference to FIGS. 2, 3A, 3B and 4, the first intermediate section 104 and the second intermediate section 106 neighboring each other can be partially joined to each other at or near the bottom 113 of the packaging member 100. Each of the joined portions provides a hinge or folding line 136 about which the first intermediate section 104 and second intermediate section 106 pivot relative to each other. The first intermediate section 104 and second intermediate section 106 can be unjoined at the most portion of the interface therebetween.

In some embodiments, the first intermediate section 104 and the second intermediate section 106 can include two mating structures 134. Each of the mating structures 134 can have the same configuration and functions with those of the mating structure 114, except the size and location of each mating structure 134. Further, each mating structure 134 has a dovetail-shaped male member 138 and a dovetail-shaped female member 140, but not limited thereto. Each of the male and female members can have at least one undercut portion 142. In some embodiments, each mating structure 134 has same configuration and function with those of the mating structure 114 as discussed in the above.

In some embodiments, to form the dovetail-shaped male and female members complete cut portions or lines 144 can be provided between the first intermediate section 104 and the second intermediate section 106. Further, partial cut portions 146 can be provided. It can be understood that the complete cut portions 144 and the partial cut portions 146 can have the same features with those of the complete cut portions 124 and the partial cut portions 126, respectively, but not limited thereto.

With continued reference to FIGS. 2, 3A, 3B and 4, the second intermediate section 106 and the second end section 108 neighboring each other can be partially joined to each other at or near the bottom 113 of the packaging member 100. Each of the joined portions can provide a hinge or folding line 156 about which the second intermediate section 106 and second end section 108 to pivot relative to each other. In some embodiments, between the second intermediate section 106 and the second end section 108, there can be features similar to those provided between the first end section 102 and the first intermediate section 104. In other words, a mating structure 154 with a dovetail-shaped male member 158 and a dovetail-shaped female member 160 can be provided. Further, a complete cut portions 164, and a partial cut portions 166 can be provided between the second intermediate section 106 and the second end section 108. The configuration and function of the forgoing features can be understood from the discussion on the configuration and function of the mating structure 134 and the portions 144 and 146 as discussed in the above.

Referring to FIGS. 2, 3B and 4, in some embodiments, the first intermediate section 104 can have a foldable portion or tab 170 in the central area thereof. The foldable portion 170 can be formed by two complete cut portions 172 and a partial cut portion 174. As shown in FIGS. 3B and 4, the foldable portion 170 can be joined to the body portion of the first intermediate section 104 at or near the bottom 113 to provide a hinge or folding line 176 about which the foldable portion pivots. In some embodiments, the first intermediate section 104 can have two opposing shoulder forming structures 1042 and 1044. The two opposing structures 1042 and 1044 can form portions 9022 and 9042 of cushioning shoulders 902 and 904 of the packaging corner block 72, respectively, as shown in FIG. 1B. The foldable portion 170 is disposed between the two opposing structures 1042 and 1044.

Referring to FIGS. 2, 3B and 4, the second intermediate section 106 can also have a foldable portion or tab 180 in the central area of the second intermediate section 106. Similarly to the foldable portion 170, the foldable portion 180 can be formed by two complete cut portions 182 and a partial cut portion 184. As shown in FIGS. 3B and 4, the foldable portion 180 can be joined to a body portion of the second intermediate section 106 at the bottom 113 to provide a hinge or folding line 86 about which the foldable portion 180 pivots.

In some embodiments, the second intermediate section 106 can have two opposing shoulder forming structures 1062 and 1064. Two opposing structures 1062 and 1064 can form portions 9024 and 9044 of cushioning shoulders 902 and 904 of the packaging corner block 72, respectively, as shown in FIG. 1B. The foldable portion 180 is disposed between the two opposing structures 1062 and 1064. In some embodiments, the second intermediate section 106 can further include a support forming portion 1066, which can form a portion of the cushioning support 906 of the packaging corner block 72 shown in FIG. 1B. The support forming portion 1066 extends from the partial cut portion 184 to the dovetail-shaped male member 162.

When folding the foldable portions 170 and 180, a slot can be formed in the first and second intermediate sections 104 and 106. Thus, each foldable portion 170 or 180 can be designed to provide a width sufficient to provide the slot. The slot can have a width so that the corner portion of the article 80 can be snugly inserted therein, but not limited thereto. For example, the length of the foldable portion 180 can be designed greater than that of the foldable portion 170 to provide additional cushioning for the article 80 when it is folded as described in greater detail later. Between the foldable portions 170 and 180, a hole 188 can be provided to form a portion of the slot. The hole 188 can be provided between the mating structures 134.

In some alternative embodiments, in order to form the slot 90 in the packaging corner block 72 an elongated hole as a slot forming portion can be provided in the packaging member 100 instead of features of the foldable portions 170 and 180 and the small hole 188. The elongated hole can extend through the first and second intermediate sections 104 and 106. The elongated hole can form the slot 90 of the deployed configuration of the packaging corner block 72 to receive the corner portion of the article 80 when the packaging member is in the folded state.

Figure 5:
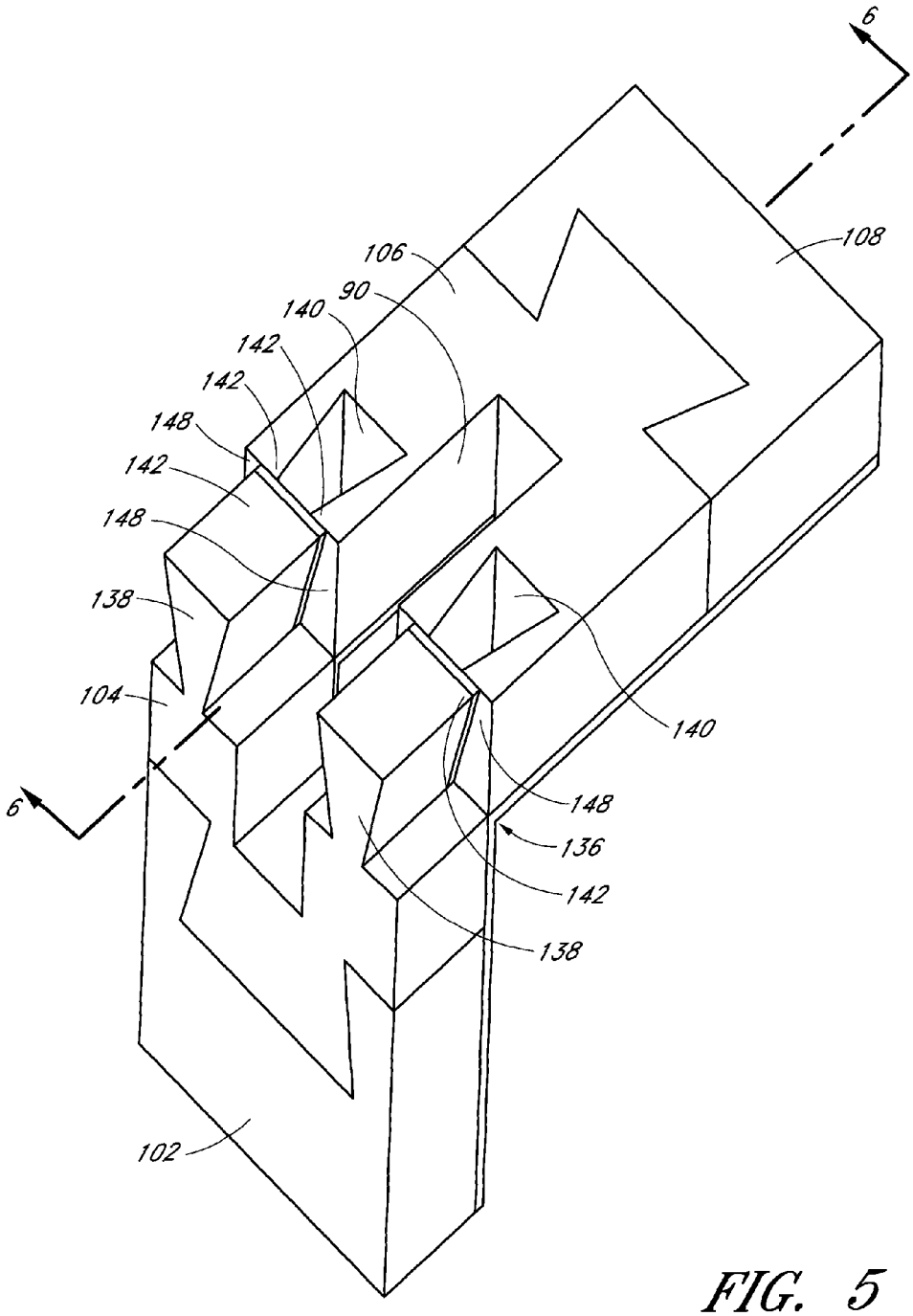
FIG. 5 is a front, top, and right side perspective view of the packaging member in a first partially folded state.
Figure 6:
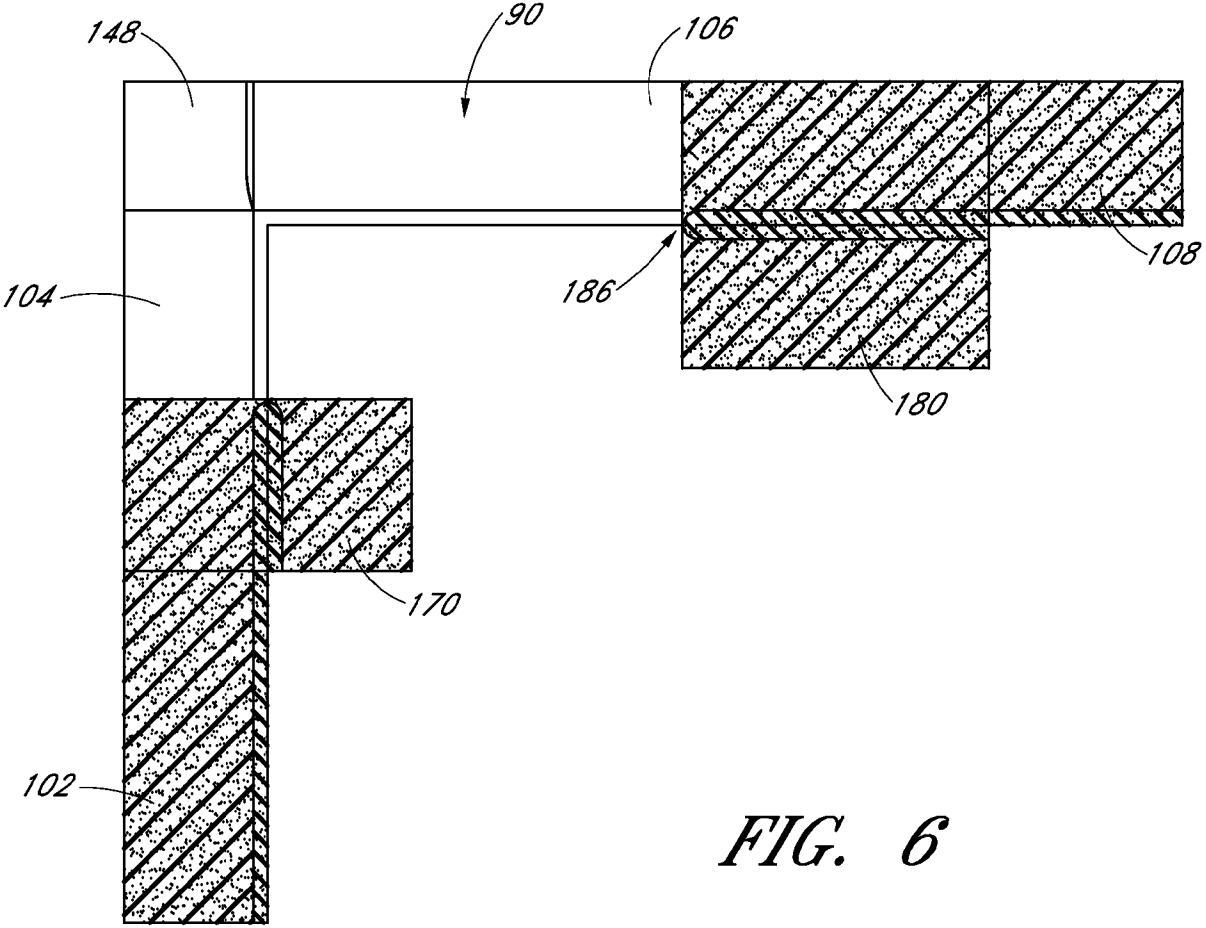
FIG. 6 is a sectional view taken along the line 6-6 of FIG. 5.

Referring to FIGS. 5 and 6, the first intermediate section 104 can be folded downwardly about the hinge 136 relative to the second intermediate section 106. When a user applies force to fold the first intermediate section 104 relative to the second intermediate section 106, the undercut portions 144 can be deformed such that the dovetail-shaped male member 138 and the dovetail-shaped female member 140 are disengaged. The first intermediate section can be folded until the first intermediate section 104 is approximately perpendicular to the second intermediate section 106, but not limited thereto. In this folded state, the dovetail-shaped male member 138 and the dovetail-shaped female member 140 can be completely disengaged, and the undercut portions 142 of the dovetail-shaped male member 138 can contact end surfaces 148 of the second intermediate sections 106. As such, a lock structure can be provided such that the unfolding of the first intermediate section 106 can be prevented until a user unfolds it with intention.

As shown in FIG. 6, after or before the folding of the first and second intermediate sections 104, the foldable portions 170 and 180 can be folded about the hinges 176 and 186, respectively. Thus, the slot 90 can be formed in the first and second intermediate sections 104 and 106.

Figure 7:
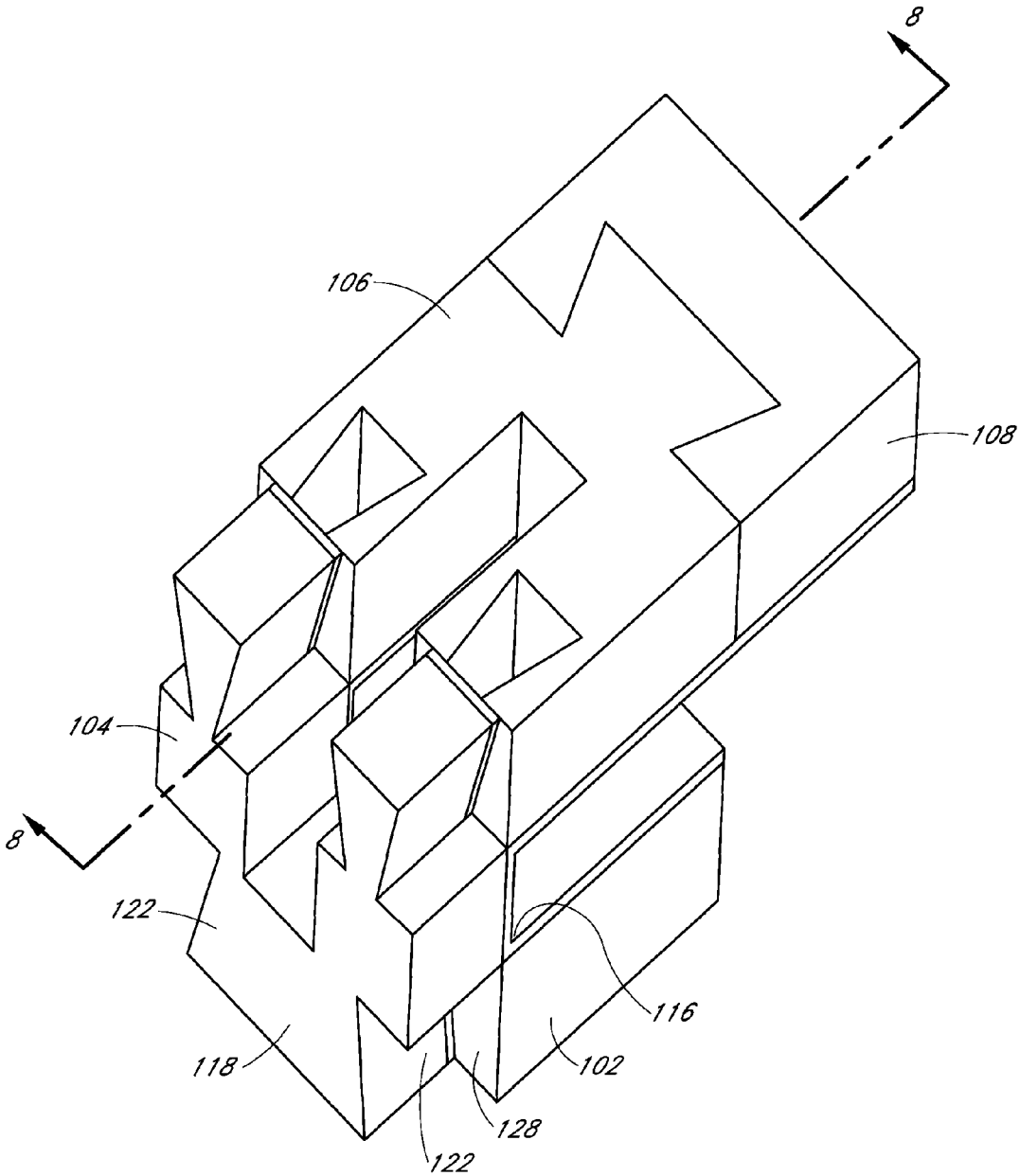
FIG. 7 is a front, top, and right side perspective view of the packaging member in a second partially folded state.
Figure 8:
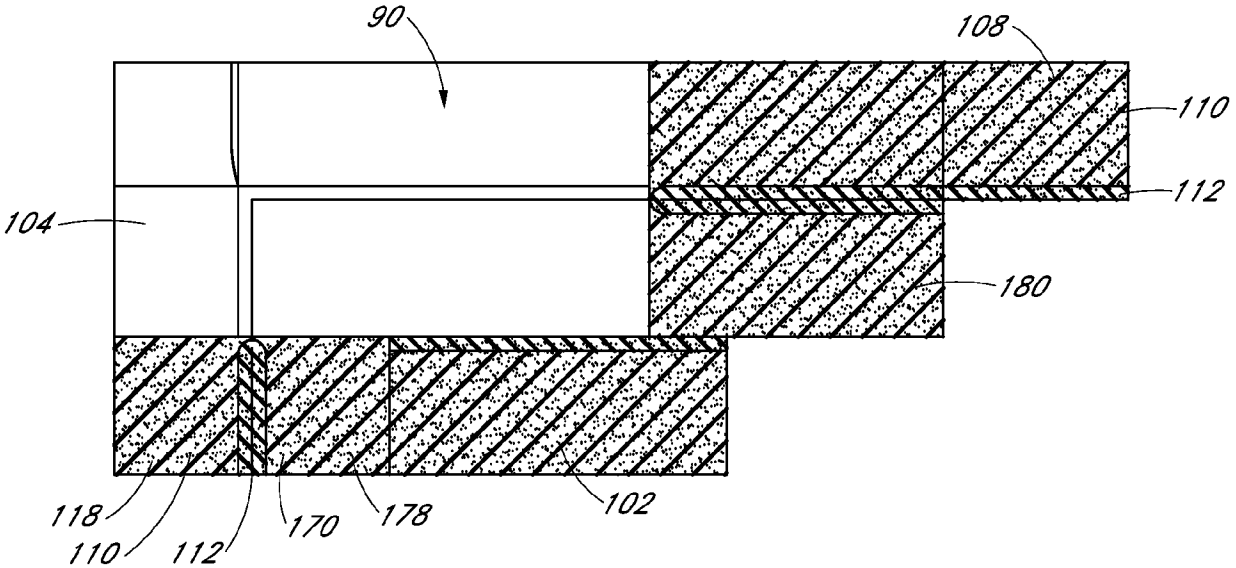
FIG. 8 is a sectional view taken along the line 8-8 of FIG. 7.

Referring to FIGS. 7 and 8, the first end section 102 can be folded upwardly about the hinge 116 relative to the first intermediate section 104. When a user applies force to fold the first end section 102 relative to the first intermediate section 104, the undercut portions 122 can be deformed such that the dovetail-shaped male member 118 and the dovetail-shaped female member 120 are disengaged. In some embodiments, the first end section 102 can be folded until the first end section 102 is approximately perpendicular to the first intermediate section 104, but not limited thereto. In this folded state, the dovetail-shaped male member 118 and the dovetail-shaped female member 120 can be completely disengaged, and the undercut portions 122 of the dovetail-shaped male member 118 can contact end surfaces 128 of the first end section 102 such that the unfolding of the first end section 102 can be prevented until a user unfolds it with intention.

As illustrated in FIG. 8, the foldable portion 170 can be retained in a space formed between the dovetail-shaped male member 118 and the dovetail-shaped female member 120 which are disengaged. In some embodiments, the dovetail-shaped male member 118 and the dovetail-shaped female member 120 can be sized to form the space fitting the foldable portion 170, but not limited thereto. In this configuration, the edge portion 178 of the foldable portion 170 can provide an additional lock structure preventing the first end section 102 from unfolding until a user unfolds it.

Figure 10A:
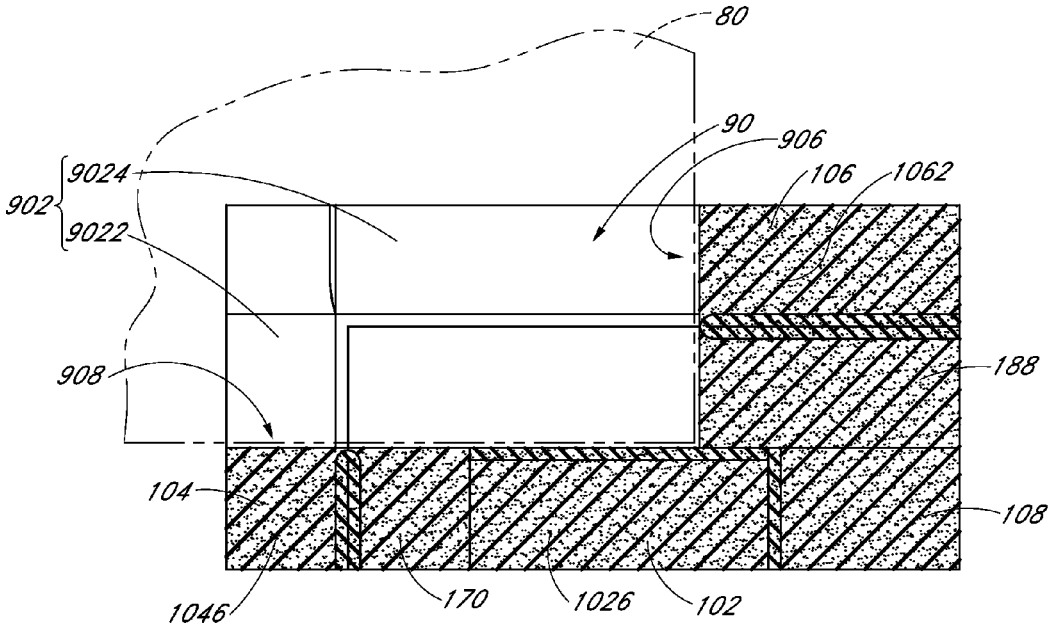
FIG. 10A is a sectional view taken along the line 10A-10A of FIG. 9.
Figure 10B:
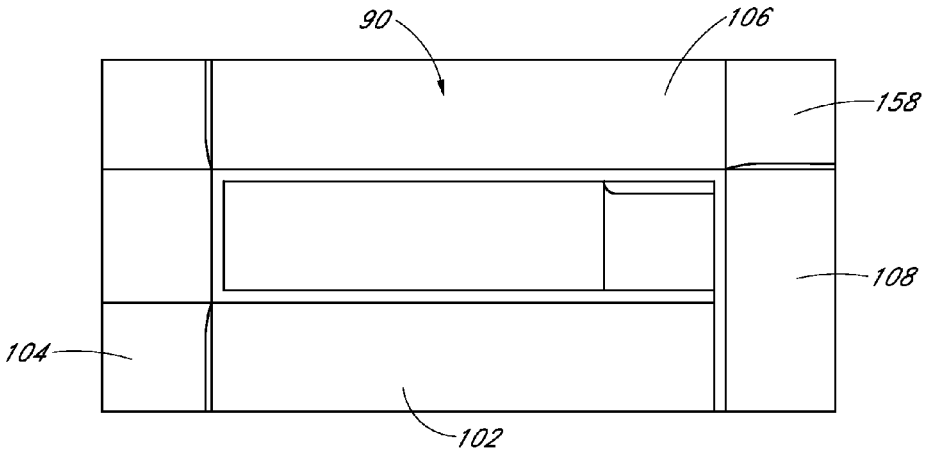
FIG. 10B is a side view of the packaging member shown in FIG. 9.

Referring to FIGS. 9, 10A and 10B, the second end section 108 can be folded downwardly about the hinge 156 relative to the second intermediate section 106. When a user applies force to pivot the second end section 108 relative to the second intermediate section 106, the undercut portions 162 can be deformed such that the dovetail-shaped male member 118 and the dovetail-shaped female member 120 are disengaged. In some embodiments, the second end section 108 can be folded until the second end section 108 is approximately perpendicular to the second intermediate section 106, but not limited thereto. In this folded state, the dovetail-shaped male member 158 and the dovetail-shaped female member 160 can be completely disengaged, and the undercut portions 162 of the dovetail-shaped male member 118 can contact end surfaces 168 of the second end section 108 such that the unfolding of the second end section 108 can be avoided until a user unfolds it.

Referring to FIG. 10A, the foldable portion 180 can be retained in a space formed between the dovetail-shaped male member 158 and the dovetail-shaped female member 160 which are disengaged. In some embodiments, the dovetail-shaped male member 158 and the dovetail-shaped female member 160 can be sized to form the space fitting the foldable portion 180, but not limited thereto. In this configuration, the edge portion 188 of the foldable portion 180 can provide an additional lock structure to prevent the second end section 108 from unfolding until a user unfolds it.

With reference to FIGS. 10A and 10B, the foldable sections 102, 104, 106 and 108 can form a circumferentially closed shape, but not limited thereto. In some embodiments, the foldable sections 102, 104, 106 and 108 can be further locked when the foldable section 108 is folded to form a circumferentially closed shape. The contact between the first and second sections 102 and 108 can prevent the second end section 108 from being further folded excessively beyond approximately 90 degrees. In turn, the other sections can be avoided from being folded excessively beyond approximately 90 degrees. Thus, the packaging member in its deployed configuration can maintain its own shape.

Referring to FIG. 1B and FIG. 10A, in some embodiments, the support forming portions 1026 and 1046 and the foldable portion 170 can collectively form the cushioning support structure 908 of the packaging corner block 72 shown in FIG. 1B. Similarly, the support forming portion 1066 and the foldable portion 180 can collectively form the cushioning support structure 906 of the packaging corner block 72 shown in FIG. 1B. As such, the foldable portions 170 and 180 can provide additional cushioning for the article 80.

It is to be understood that, in some embodiments, the folding order of the sections 102, 104, 106 and 108 can be different from the folding order discussed in the foregoing. For example, two end sections 102 and 108 can be folded prior to the folding of the first intermediate section 104 relative to the second intermediate section 106. In some embodiments, the four sections 102, 104, 106 and 108 can be simultaneously folded, but not limited thereto.

Figure 11A:
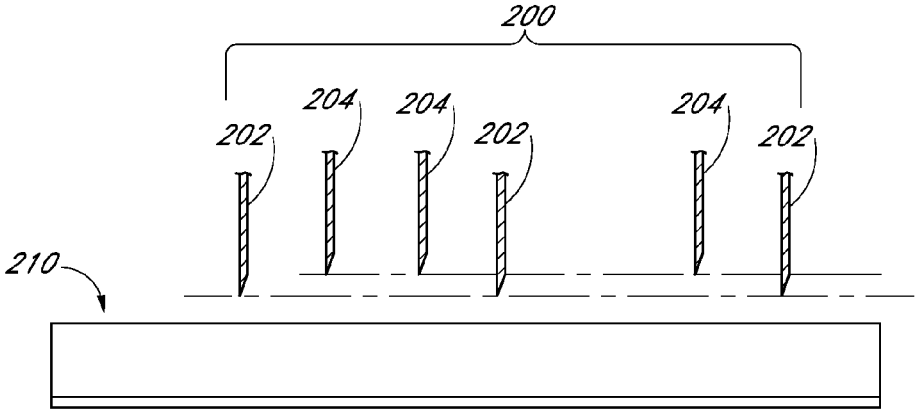
FIGS. 11A and 11B are schematic views of process for making a packaging member, FIG. 11A illustrating a state prior to cutting step and FIG. 11B illustrating a state that a cutter assembly is moved down to the lower limit.
Figure 11B:
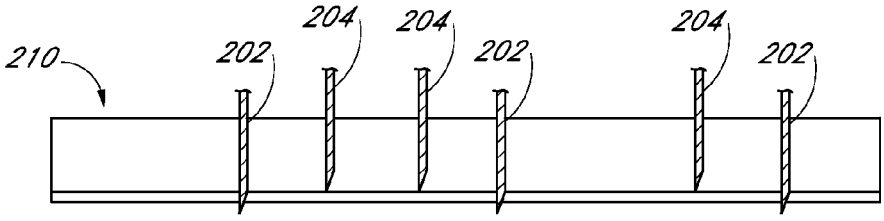

Referring to FIGS. 11A and 11B, the packaging member 100 can be manufactured using a cutter assembly 200. The cutter assembly 200 can include a first group of blades 202 and a second group of blades 204. The first group of blades 202 can be used for forming the complete cut portions 124, 144, 164, 172 and 182 of the packaging member 100, and the second group of blades 204 can be used forming the partial cut portions 126, 146, 166, 176 and 186 of the packaging member 100. To this end, the first groups of blades 202 can further extend beyond ends of the second group of blades 204 at a distance d1. The cutter assembly 200 can be attached to a punch (not shown) which can move downwardly and upwardly. However, it is to be understood that FIGS. 11A and 11B show only part of the blades, and the cutter assembly 200 can have all blades for forming all the cut portions of the packaging member 100, but not limited thereto.

A rectangular blank 210 of packaging material having a thickness for cushioning an article can be provided by blanking a packaging material which can be supplied from a roll or a large area of packaging material in some embodiments. The blank 210 can be placed at a location under the cutting assembly 200. Subsequently, the cutter assembly 200 can move down at a predetermined distance such that the second groups of the blade partially cut the blank 210 to leave the uncut or unjoined portions in the blank, i.e., the second layer 112 as illustrated in FIG. 11B. Subsequently, the cutter assembly 200 can be moved back to complete the packaging member 100.

In the above description, blanking is performed prior to forming the cut portions. In other embodiments, the cut portions can be formed prior to blanking the packaging material. In some alternative embodiments, both the blanking and the forming of the cut portions can be performed at the same time with an alternative cutter assembly which includes blanking blades as well as the first and second group of blades. In these embodiments, the packaging member 100 can be produced through only one stroke of the cutter assembly.

Figure 12:
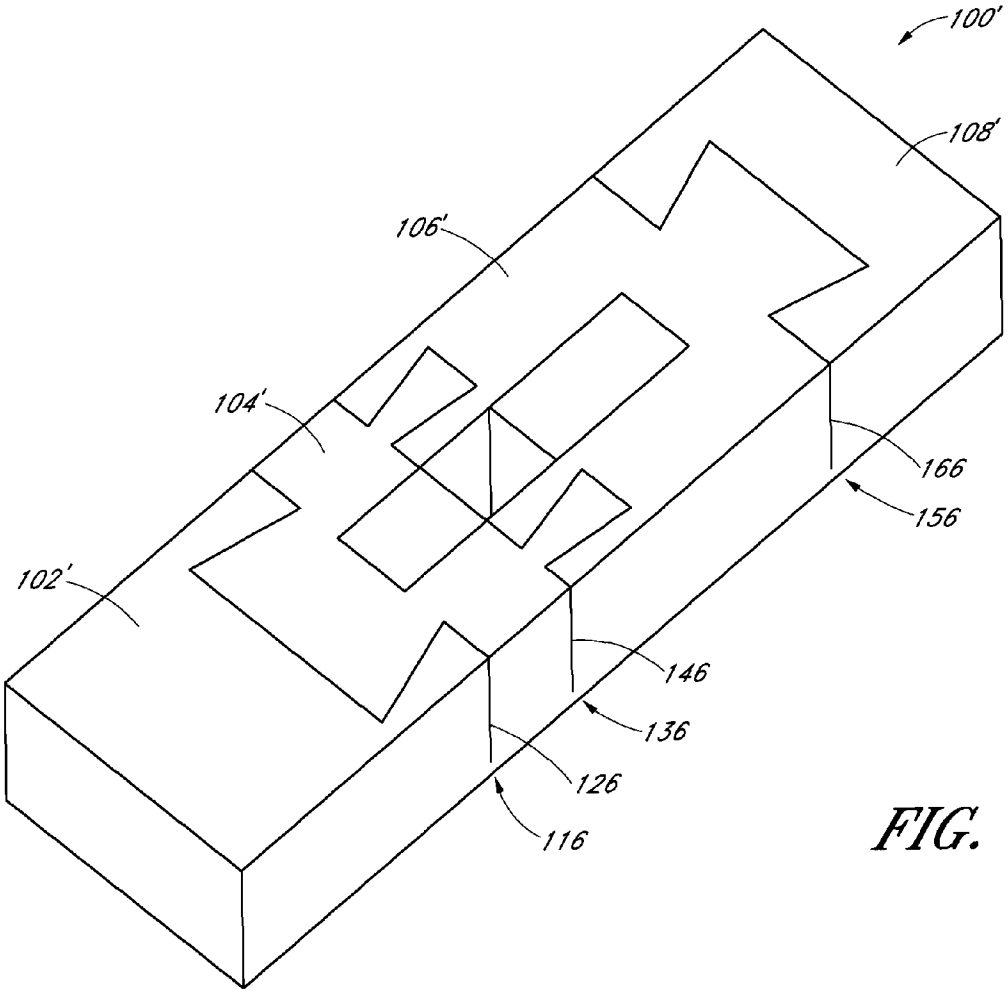
FIG. 12 is a perspective view of a packaging member in accordance with another embodiment.

With reference to FIG. 12, in some embodiments, a packaging member 100' can have one layer of a packaging material. Partial cut portions 126', 146' and 166' can leave joined portions 116', 136' and 156' between foldable sections 102', 104', 106' and 108'. In some alternative embodiments, a packaging member can be made from a packaging material have three or more layers which are attached with glue, adhesive or other bonding materials.

Although the present inventions have been described in terms of certain embodiments, other embodiments apparent to those of ordinary skilled in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A packaging member comprising:

a plurality of foldable sections arranged in a row in an unfolded state, the plurality of foldable sections configured to form a planar shaped configuration in the unfolded state, and further configured to form a block shaped configuration in a deployed state, wherein a first foldable section comprises a male member and a second foldable section comprises a female member which is configured to engage with the male member in the unfolded state, wherein the male and female members are configured to be disengaged from each other in the deployed state, wherein, in the block shaped configuration, the plurality of foldable sections configured to form a packaging corner block which comprises:

a slot formed around a corner of the packaging corner block and configured to receive a corner portion of an article, two shoulders generally opposing each other and arranged such that the slot is located therebetween, wherein one of the two generally opposing shoulders is configured to cushion the corner portion of the article received in the slot in a first direction extending between the two generally opposing shoulders, wherein the other is configured to cushion the corner portion of the article received in the slot in a second direction opposite to the first direction, a first cushioning support configured to cushion the corner portion of the article received in the slot in a third direction perpendicular to the first direction, a second cushioning support configured to cushion the corner portion of the article received in the slot in a fourth direction perpendicular to the first and third directions, and a foldable tab pivotably connected to the first foldable section and configured to be inserted between the male and female members which are disengaged in the deployed state.

2. The packaging member of claim 1, wherein the packaging corner block has a generally rectangular cuboid shape.

3. The packaging member of claim 1, wherein, in the deployed state, the plurality of foldable sections are arranged to form a circumferentially closed shape of the packaging corner block.

4. The packaging member of claim 3, wherein the plurality of foldable sections comprises two end portions located at opposing ends of the packaging member in the unfolded state, respectively, wherein the two end foldable sections abut each other in the deployed state.

5. The packaging member of claim 1, wherein the second foldable section immediately neighbors the first foldable section, wherein the first and second foldable sections are hingedly connected to each other such that the first foldable section is pivotable with respect to the second foldable section about a hinge.

6. The packaging member of claim 1, wherein each of the male member and the female member has a trapezoidal shape.

7. The packaging member of claim 1, wherein the male and female members are configured to interfere each other and at least partially deform when the first foldable section pivots relative to the second foldable section between the unfolded state and the deployed state.

8. The packaging member of claim 1, wherein the male and female members are configured not to interfere each other when the packaging member is in the unfolded state or in the deployed state.

9. The packaging member of claim 1, wherein the male and female members are configured to form a lock mechanism which is configured to keep the first and second foldable sections in the unfolded state or in the deployed state.

10. The packaging member of claim 1, wherein the packaging member comprises a cushioning material of an expanded compressible, resilient material.

11. The packaging member of claim 1, wherein the packaging member is formed in a single piece.

12. The packaging member of claim 1, wherein the packaging member has a thickness substantially uniform throughout the foldable sections in the unfolded state.

13. The packaging member of claim 1, wherein each of the plurality of foldable sections comprises a first layer of a cushioning material and a second layer of a sheet material attached to the first layer, wherein the first layers of two immediately neighboring foldable sections among the plurality of foldable sections are unjoined while the second layers of the immediately neighboring foldable sections are at least partially joined each other.

14. The packaging member of claim 1, wherein a first one of the plurality of foldable sections comprises a slot forming portion configured to form at least part of the slot of the packaging corner block in the deployed state and two shoulder forming portions configured to form the two shoulders of the packaging corner block in the deployed state.

15. The packaging member of claim 14, wherein the first foldable section comprises a portion configured to form the first cushioning support of the packaging corner block in the deployed state.

16. The packaging member of claim 1, wherein a second one of the plurality of foldable sections is configured to form the second cushioning support of the packaging corner block in the deployed state.

17. A method of packaging an article, the method comprising:

providing a box having at least a corner;

providing the packaging member of claim 1 in its unfolded state;

folding the packaging member into the block shaped configuration thereby forming the packaging corner block;

placing the packaging corner block inside the box at the corner of the box; and inserting a corner of an article into the slot of the packaging corner block.

18. The method of claim 17, wherein subsequent to inserting the packaging corner block is placed inside the box at the corner of the box.

19. The method of claim 17, wherein subsequent to placing the packaging corner block inside the box at the corner of the box, the corner of an article is inserted into the slot of the packaging corner block.

20. A packaging system comprising:

a box comprising a corner and configured to contain an article; and the packaging member of claim 1 in its folded state, the packaging member being disposed at the corner of the box to receive a corner of the article.

21. A package kit comprising:

a box forming member comprising a plurality of foldable portions configured to form walls of a box in its folded state, wherein the box comprises a corner and is configured to contain an article; and the packaging member of claim 1, wherein the packaging member is configured to form, in its folded state, the packaging corner block which fits the corner of the box and is configured to receive a corner of the article.

22. A method of making a packaging member, the method comprising:

providing a packaging material comprising a first layer and a second layer; and partially cutting the packaging material into the plurality of foldable sections of the packaging member of claim 1 such that two immediately neighboring foldable sections are at least partially joined at the second layer.

23. The method of claim 22, wherein the first layer comprises a cushioning material and the second layer comprises a sheet material.

24. A packaging member comprising:

first, second, third, and fourth foldable sections arranged in a row in an unfolded state, the first, second, third, and fourth foldable sections being connected together as first, second, and third parallel folds and configured to form a planar shaped configuration in the unfolded state, and further configured to form a circumferentially closed, block shaped configuration in a deployed state when the first, second, third, and fourth foldable sections are folded by about ninety degrees at each of the first, second and third parallel folds;

wherein, in the block shaped configuration, the plurality of foldable sections configured to form a packaging corner block which comprises:

a slot formed around a corner of the packaging corner block and configured to receive a corner portion of an article;

two shoulders generally opposing each other and arranged such that the slot is located therebetween, wherein one of the two generally opposing shoulders is configured to cushion the corner portion of the article received in the slot in a first direction extending between the two generally opposing shoulders, wherein the other is configured to cushion the corner portion of the article received in the slot in a second direction opposite to the first direction;

a first cushioning support configured to cushion the corner portion of the article received in the slot in a third direction perpendicular to the first direction; and a second cushioning support configured to cushion the corner portion of the article received in the slot in a fourth direction perpendicular to the first and third directions.

25. A packaging member comprising:

a plurality of foldable sections arranged in a row in an unfolded state, the plurality of foldable sections configured to form a planar shaped configuration in the unfolded state, and further configured to form a block shaped configuration in a deployed state, wherein a first foldable section comprises a male member and a second foldable section comprises a female member which is configured to engage with the male member in the unfolded state, wherein the male and female members are configured to be disengaged from each other in the deployed state, wherein, in the block shaped configuration, the plurality of foldable sections configured to form a packaging corner block which comprises:

a slot formed around a corner of the packaging corner block and configured to receive a corner portion of an article, two shoulders generally opposing each other and arranged such that the slot is located therebetween, wherein one of the two generally opposing shoulders is configured to cushion the corner portion of the article received in the slot in a first direction extending between the two generally opposing shoulders, wherein the other is configured to cushion the corner portion of the article received in the slot in a second direction opposite to the first direction, a first cushioning support configured to cushion the corner portion of the article received in the slot in a third direction perpendicular to the first direction, a second cushioning support configured to cushion the corner portion of the article received in the slot in a fourth direction perpendicular to the first and third directions, a foldable tab pivotably connected to the first foldable section and configured to be inserted between the male and female members which are disengaged in the deployed state, and wherein the foldable tab is configured to interfere with the female member when the foldable tab pivots relative to the first foldable section.

* * * * *

UNITED STATES PATENT AND TRADEMARK OFFICE

CERTIFICATE OF CORRECTION

PATENT NO. : 8,752,707 B2
APPLICATION NO. : 12/958261
DATED : June 17, 2014
INVENTOR(S) : John McDonald et al.

It is certified that error appears in the above-identified patent and that said Letters Patent is hereby corrected as shown below:

On the title page

Page 1 (item 74, Attorney) at line 1, Change "Knobee" to --Knobbe--.

In the drawings

Sheet 11 of 14 (FIG. 9) at line 10 (approx.), Below "figure" insert --FIG. 9--.

Signed and Sealed this
Seventeenth Day of November, 2015

Michelle K. Lee

Michelle K. Lee
*Director of the United States Patent and Trademark Office*